US008294620B2

(12) United States Patent
Flint et al.

(10) Patent No.: US 8,294,620 B2
(45) **Date of Patent: *Oct. 23, 2012**

(54) INTEGRATED DUAL-BAND ANTENNA FOR LAPTOP APPLICATIONS

(75) Inventors: Ephraim B. Flint, Lincoln, MA (US); Brian P. Gaucher, Brookfield, CT (US); Duixian Liu, Yorktown Heights, NY (US)

(73) Assignee: Lenovo (Singapore) Pte Ltd., Singapore (SG)

( * ) Notice: Subject to any disclaimer, the term of this patent is extended or adjusted under 35 U.S.C. 154(b) by 212 days.

This patent is subject to a terminal disclaimer.

(21) Appl. No.: 10/370,976

(22) Filed: Feb. 20, 2003

(65) Prior Publication Data

US 2003/0222823 A1 Dec. 4, 2003

Related U.S. Application Data

(63) Continuation-in-part of application No. 09/866,974, filed on May 29, 2001, now Pat. No. 6,686,886.

(51) Int. Cl.
*H01Q 1/24* (2006.01)
*H01Q 21/30* (2006.01)

(52) U.S. Cl. ..... 343/702; 343/725; 343/767; 343/846

(58) Field of Classification Search ..... 343/702, 343/700 MS, 846, 795, 713, 826, 828, 829, 343/725, 767

See application file for complete search history.

(56) References Cited

U.S. PATENT DOCUMENTS

| | | | | |
|---|---|---|---|---|
| 4,131,892 | A | 12/1978 | Munson et al. | |
| 4,131,893 | A | 12/1978 | Munson et al. | |
| 4,367,475 | A | 1/1983 | Schiavone | |
| 4,641,366 | A * | 2/1987 | Yokoyama et al. | 455/73 |
| 4,968,984 | A * | 11/1990 | Katoh et al. | 343/713 |
| 5,138,328 | A * | 8/1992 | Zibrik et al. | 343/702 |
| 5,365,246 | A * | 11/1994 | Rasinger et al. | 343/702 |
| 5,644,319 | A * | 7/1997 | Chen et al. | 343/702 |
| 5,677,698 | A * | 10/1997 | Snowdon | 343/770 |
| 6,057,801 | A * | 5/2000 | Desclos et al. | 343/700 MS |
| 6,184,833 | B1 * | 2/2001 | Tran | 343/700 MS |
| 6,307,520 | B1 | 10/2001 | Liu | |
| 6,339,400 | B1 * | 1/2002 | Flint et al. | 343/702 |
| 6,377,226 | B1 * | 4/2002 | Ha et al. | 343/791 |
| 6,539,207 | B1 * | 3/2003 | del Castillo et al. | 455/90.3 |

(Continued)

FOREIGN PATENT DOCUMENTS

EP 1011167 A1 10/1998

(Continued)

OTHER PUBLICATIONS

David Pogue, "The iBook: What Steve Jobs Didn't Say", in MacWorld on the web, pp. 1-3, Jul. 18, 1999.

(Continued)

*Primary Examiner* — Michael C Wimer
(74) *Attorney, Agent, or Firm* — Frank V. DeRosa, Esq

(57) ABSTRACT

Dual-band antennas that are embedded within portable devices such as laptop computers. In one aspect, a dual-band antenna for a portable device (e.g., laptop computer) includes a first element having a resonant frequency in a first frequency band and a second element having a resonant frequency in a second frequency band, wherein the first element is connected to a signal feed, wherein the second element is grounded, and wherein the first and second elements are integrated within a portable device.

20 Claims, 11 Drawing Sheets

U.S. PATENT DOCUMENTS

| | | | | |
|---|---|---|---|---|
| 6,614,400 | B2 * | 9/2003 | Egorov | 343/702 |
| 6,650,294 | B2 * | 11/2003 | Ying et al. | 343/700 MS |
| 6,686,886 | B2 * | 2/2004 | Flint et al. | 343/702 |

FOREIGN PATENT DOCUMENTS

| | | |
|---|---|---|
| JP | 06-023311 | 3/1994 |
| JP | 09-326632 | 12/1997 |
| JP | 11-312923 | 9/1999 |
| JP | 2000-172376 | 6/2000 |
| WO | WO 9506338 | 3/1995 |
| WO | 99/43037 | 8/1999 |

OTHER PUBLICATIONS

Anonymous, Apple PoweBook G3 500 MHz Full Review, in PC Magazine on the web, pp. 1-2, date unknown.

Wendy J. Mattson, "Fast PowerBooks Start to Arrive", in MacWeek.com, pp. 1-2, Jun. 7, 1999.

Andy (last name unknown), "The Vision Thing: No Strings Attached", in MacWorld on the web, pp. 1-3, Jul. 18, 1999.

Anonymous, "Apple Introduces AirPort Wireless Networking", in CreativePro.com on the web, pp. 1-2, Jul. 21, 1999.

Anonymous, "Apple PowerBook G4 Technical Specifications", pp. 1-4, 2001.

Anonymous, "PowerBook G4", pp. 1-4, Jan. 2001.

John D. Kraus, "Antennas", 2d Edition, McGraw-Hill, 1988, pp. 624-645.

Color Photograph of Apple® Power Book® computer showing enlarged view of antenna on top left of display, reflecting product as available on or about Jul. 26, 2000, date of product introduction unknown.

Color Photograph of Apple® Power Book® computer showing enlarged view of antenna on middle of right display frame, reflecting product as available on or about Jul. 26, 2000, date of product introduction number unknown.

Color Photograph of Apple® Power Book® computer showing first antenna on top left of display and second antenna on middle of right display frame, reflecting product as available on or about Jul. 26, 2000, date of product introduction unknown.

James J R. , Hall P.S.: Handbook of Microstrip Antennas, 1989, Peter Peregrinus Ltd., London, UK , pp. 320-327.

* cited by examiner

FRONT SIDE

BACK SIDE (a)

(b)

(c)

INTEGRATED DUAL-BAND ANTENNA FOR LAPTOP APPLICATIONS

CROSS-REFERENCE TO RELATED APPLICATION

This application is a Continuation-in-Part of U.S. patent application Ser. No. 09/866,974, filed on May 29, 2001, now U.S. Pat. No. 6,686,886 which is fully incorporated herein by reference.

TECHNICAL FIELD OF THE INVENTION

The present invention relates generally to antennas for use with portable devices. More specifically, the invention relates to integrated (embedded) dual-band antennas for use with portable computers (laptops).

BACKGROUND

To provide wireless connectivity between a portable processing device (e.g., laptop computer) and other computers (laptops, servers, etc.), peripherals (e.g., printers, mouse, keyboard, etc.) or communication devices (modem, smart phones, etc.) it is necessary to equip the portable device with an antenna. For example, with portable laptop computers, an antenna may be located either external to the device or integrated (embedded) within the device (e.g., embedded in the display unit).

For example, FIG. 1 is a diagram illustrating various embodiments for providing external antennas for a laptop computer. For instance, an antenna (100) can be located at the top of a display unit of the laptop. Alternatively, an antenna (101) can be located on a PC card (102). The laptop computer will provide optimum wireless connection performance when the antenna is mounted on the top of the display due to the very good RF (radio frequency) clearance. There are disadvantages, however, associated with laptop designs with external antennas including, for example, high manufacture costs, possible reduction of the strength of the antenna (e.g., for a PC card antenna (102)), susceptibility of damage, and the effects on the appearance of the laptop due to the antenna.

Other conventional laptop antenna designs include embedded designs wherein one or more antennas are integrally built (embedded antenna) within a laptop. For example, FIG. 2 illustrates conventional embedded antenna implementations, wherein one or more antennas (200, 201, 202) (e.g., whip-like or slot embedded antenna) are embedded in a laptop display. In one conventional embodiment, two antennas are typically used (although applications implementing one antenna are possible). In particular, two embedded antennas (200, 201) can be placed on the left and right edges of the display. The use of two antennas (as opposed to one antenna) will reduce the blockage caused by the display in some directions and provide space diversity to the wireless communication system.

In another conventional configuration, one antenna (200 or 201) is disposed on one side of the display and a second antenna (202) is disposed in an upper portion of the display. This antenna configuration may also provide antenna polarization diversity depending on the antenna design used.

Although embedded antenna designs can overcome some of the above-mentioned disadvantages associated with external antenna designs (e.g., less susceptible to damage), embedded antenna designs typically do not perform as well as external antennas. To improve the performance of an embedded antenna, the antenna is preferably disposed at a certain distance from any metal component of a laptop. For example, depending on the laptop design and the antenna type used, the distance between the antenna and any metal component should be at least 10 mm. Another disadvantage associated with embedded antenna designs is that the size of the laptop must be increased to accommodate antenna placement, especially when two or more antennas are used (as shown in FIG. 2).

U.S. Pat. No. 6,339,400, issued to Flint et al. on Jan. 15, 2002, entitled "Integrated Antenna For Laptop Applications", which is commonly assigned and incorporated herein by reference, discloses various embedded antenna designs, which provide improvements over conventional embedded antenna designs. More specifically, the patent describes various embodiments wherein embedded antennas are (i) disposed on edges of the laptop display wherein a metal frame of the display unit is used as a ground plane for the antennas, and/or (ii) formed on a conductive RF shielding foil disposed on the back of the display, wherein coaxial transmission lines are used to feed the antennas (e.g., the center conductors are coupled to the radiating element of the antenna and the outer (ground connector) is coupled to the metal rim of the display unit). Advantageously, these integrated designs support many antenna types, such as slot antennas, inverted-F antenna and notch antennas, and provide many advantages such as smaller antenna size, low manufacturing costs, compatibility with standard industrial laptop/display architectures, and reliable performance.

Continuing advances in wireless communications technology has lead to significant interest in development and implementation of wireless computer applications. For instance, spontaneous (ad hoc) wireless network connectivity can be implemented using the currently emerging "Bluetooth" networking protocol. Briefly, Bluetooth is a protocol for providing short-range wireless radio links between Bluetooth-enabled devices (such as smartphones, cellular phone, pagers, PDAs, laptop computers, mobile units, etc.). Bluetooth enabled devices comprise a small, high performance, low-power, integrated radio transceiver chip comprising a baseband controller for processing input/output baseband signals using a frequency-hop spread-spectrum system, as well as a modulator/demodulator for modulating/demodulating a carrier frequency in the 2.4 GHz ISM (industrial-scientific-medical) band.

Currently, the 2.4 GHz ISM band is widely used in wireless network connectivity. By way of example, many laptop computers incorporate Bluetooth technology as a cable replacement between portable and/or fixed electronic devices and IEEE 802.11b technology for WLAN (wireless local area network). If an 802.11b device is used, the 2.4 GHz band can provide up to 11 Mbps data rate. For much higher data rates, the 5 GHz U-NII (unlicensed national information infrastructure) can be used. U-NII devices operating on the 5.15-5.35 GHz frequency range can provide data rates up to 54 Mbps.

As a result, the demand for a dual-band antenna operating at both bands is increasing. Dual-band antennas with one feed have some advantages over multi-feed antennas for wireless LAN applications. As wireless communications among processing devices become increasingly popular and increasingly complex, a need exists for a compact integrated dual-band antenna having reduced costs and reliable performance.

SUMMARY OF THE INVENTION

The present invention is directed to dual-band antennas that are embedded within portable devices such as laptop computers. In one aspect of the invention, a dual-band antenna for a portable device (e.g., laptop computer) comprises a first element having a resonant frequency in a first frequency band and a second element having a resonant frequency in a second frequency band, wherein the first element is connected to a signal feed, wherein the second element is grounded, and wherein the first and second elements are integrated within a portable device.

Preferably, an integrated dual-band antenna operates in a first frequency band of about 2.4 GHz to about 2.5 GHz and a second frequency band of about 5.15 GHz to about 5.35 GHz.

In another aspect, the first and second elements of the dual-band antenna comprise metal strips formed on a PCB (printed circuit board) substrate. The PCB is preferably mounted to a metal support frame of a display unit of the portable device.

In yet another aspect of the invention, the first and second elements of the dual band antenna are integrally formed with a metallic cover of a display unit of the portable device.

In another aspect of the invention, the first and second elements of the dual-band antenna are integrally formed with an RF shielding foil of the display unit of the portable device.

In other aspects of the invention, the first and second elements of a dual-band antenna comprise one of various antenna elements. For instance, in one embodiment, the first element comprises an inverted-F antenna element and the second element comprises an inverted-L antenna element. In another embodiment, the first element comprises an inverted-F antenna element and the second element comprises a slot antenna element. In another embodiment, the first element comprises a slot antenna element and the second element comprises a slot antenna element. In yet another embodiment, the first element comprises a slot antenna element and the second element comprises an inverted-L antenna element.

These and other aspects, objects, embodiments, features and advantages of the present invention will be described or become apparent from the following detailed description of preferred embodiments, which is to be read in connection with the accompanying drawings.

BRIEF DESCRIPTION OF THE DRAWINGS

FIG. 22(*b*) is an exemplary diagram illustrating dimensional parameters of the dual-band antenna of FIG. 22(*a*) according to an embodiment of the present invention, which are used for determining operating characteristics of the dual-band antenna.

FIG. 22(*c*) illustrates an implementation of the dual-band antenna of FIG. 22(*a*) as constructed by stamping a metal sheet or patterning a PCB (printed circuit board).

DETAILED DESCRIPTION OF PREFERRED EMBODIMENTS

A dual-band antenna according to an embodiment of the present invention is preferably designed for ISM and U-NII band applications, although a dual-band antenna according to the invention can be implemented for other applications such as dual-band cellular applications. A dual-band antenna according to the invention is capable of operating at either of two desired resonant frequencies, e.g., 800 MHz and 1900 MHz and 2.45 GHz and 5 GHz, etc. In preferred embodiments of the present invention, dual-band antennas are extensions of the single-band integrated antenna designs for laptop applications as disclosed in the above-incorporated U.S. Pat. No. 6,339,400. More specifically, a dual-band antenna according to an embodiment of the invention comprises an additional radiating element which is electromagnetically coupled to a single-band antenna to achieve dual-band performance, while providing space efficiency. Advantageously, the size and manufacturing costs of a dual-band antenna according to the invention is similar to that of a single-band antenna as disclosed in U.S. Pat. No. 6,339,400.

Figure 1:
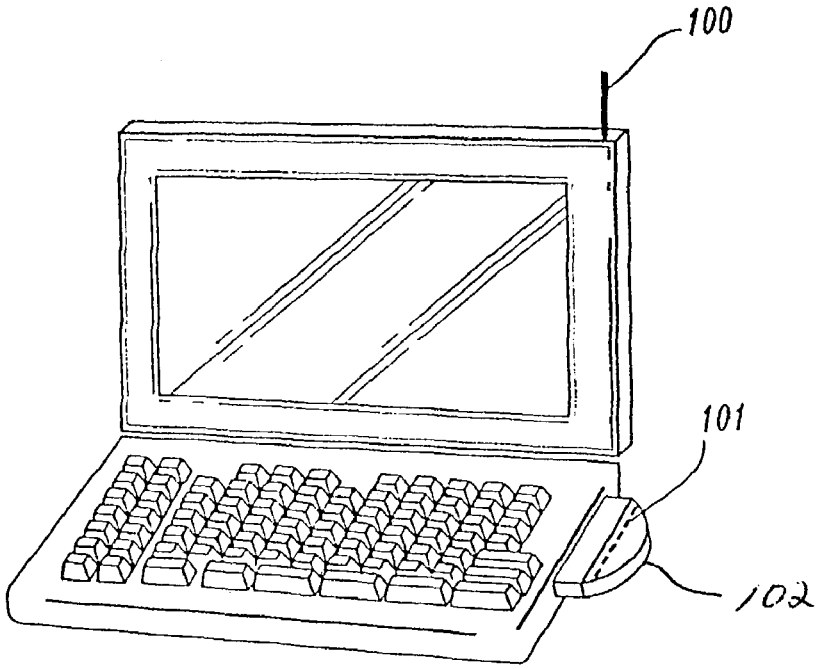
FIG. 1 (Prior Art)
FIG. 1 is a diagram illustrating various conventional embodiments of external antennas for a laptop computer.
Figure 2:
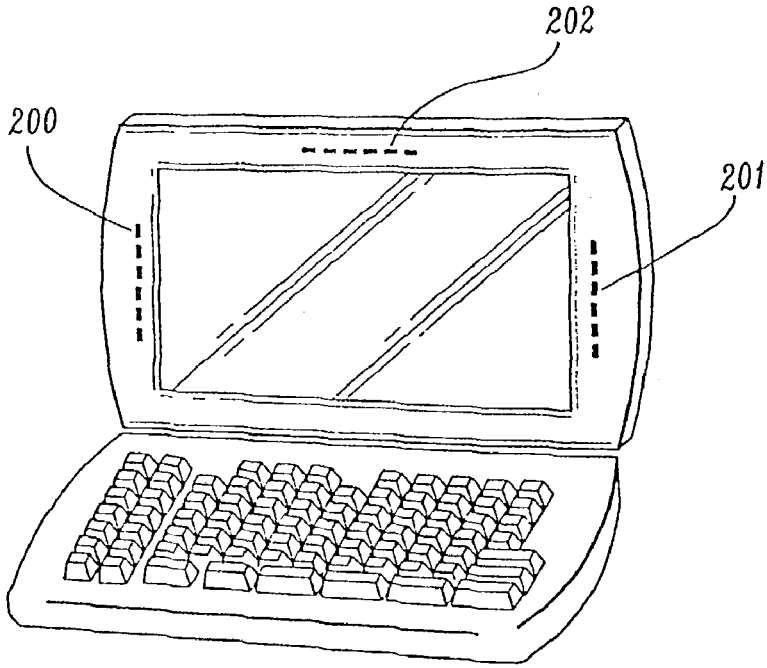
FIG. 2 (Prior Art)
FIG. 2 is a diagram illustrating various conventional embodiments of embedded (integrated) antennas for a laptop computer.
Figure 3:
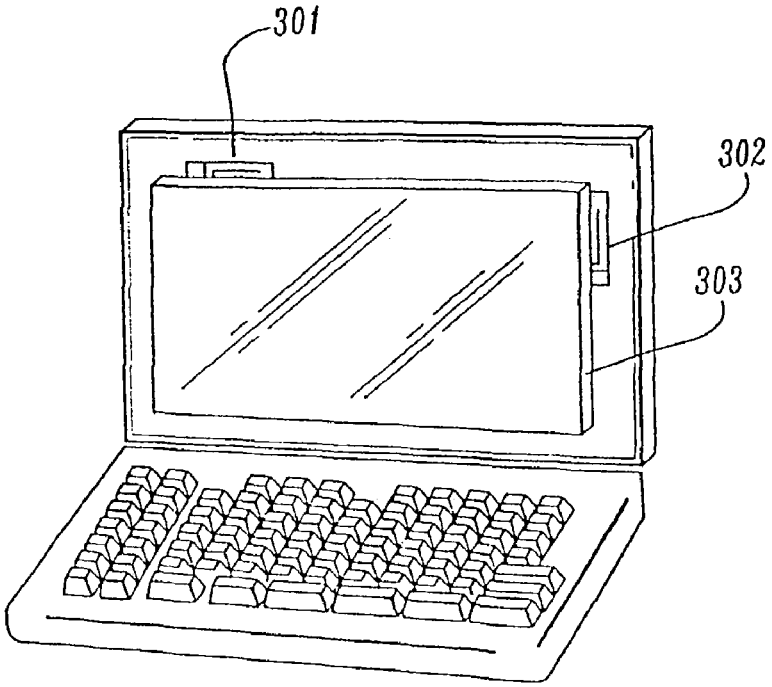
FIGS. 3, 4, 5 and 6 are schematic diagrams illustrating various orientations for mounting dual-band antennas on a laptop display unit according to the invention.
Figure 4:
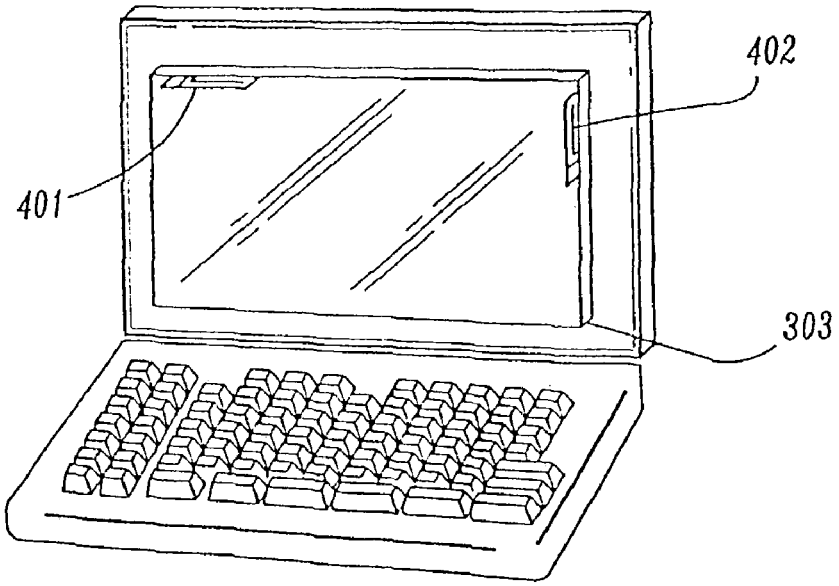

FIGS. 3 and 4 are schematic diagrams illustrating various orientations for mounting dual-band antennas on a laptop display unit according to the invention. More specifically, FIG. 3 illustrates a pair of dual-band antennas (301, 302) that are mounted to a metal support frame (303) of a laptop display unit, wherein a plane of each dual-band antenna (301, 302) is substantially parallel to the plane (or along the plane) of the support frame (303). FIG. 4 illustrates a pair of dual-band antennas 401, 402 that are mounted to a metal support frame (303) of the laptop display unit, wherein a plane of each of the dual-band antennas (401, 402) is disposed substantially perpendicular to a plane of support frame (303). The dual-band antennas (301, 302, 401 and 402) are referred to herein as "slot dual-band antennas", the structure of which will be described in further detail below.

In FIGS. 3 and 4, the dual-band antennas (302) and (402) can be positioned on the left side of the display frame (303) (as opposed to the right side of the frame as shown) and the dual-band antennas (301) and (401) can be located on the right side of the upper portion of the frame (303) (as opposed to the left side of the upper portion of the frame as shown). In the exemplary embodiments of FIGS. 3 and 4, the dual-band antennas are connected to the display frame (303) of the laptop display to ground the dual-band antennas. The metal support frame and/or RF shielding foil on the back of the display unit can be part of the dual-band antenna as discussed herein. Either parallel antennas (FIG. 3) or perpendicular antennas (FIG. 4) (or other orientations, e.g., 45 degrees) may be implemented depending on the industrial design needs and both implementations provide similar performances.

Figure 5:
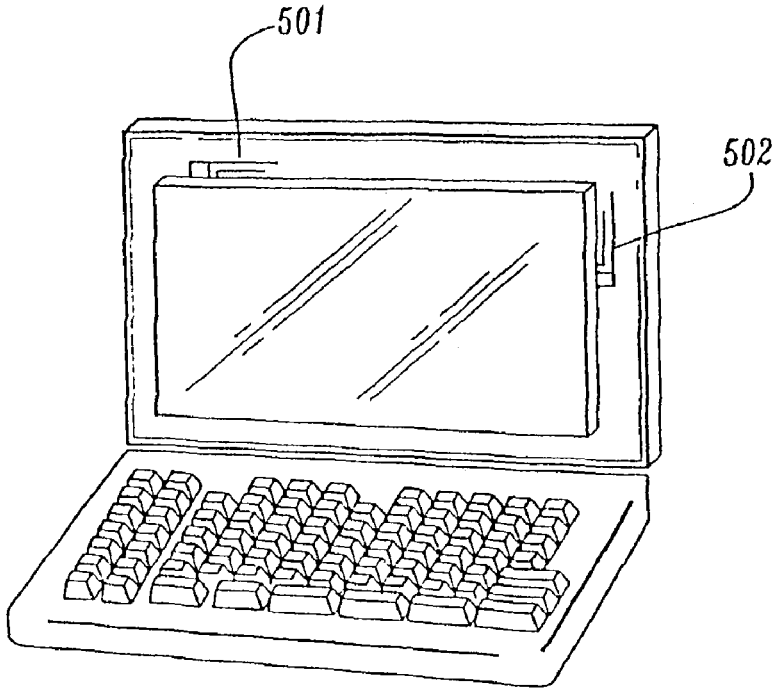
Figure 6:
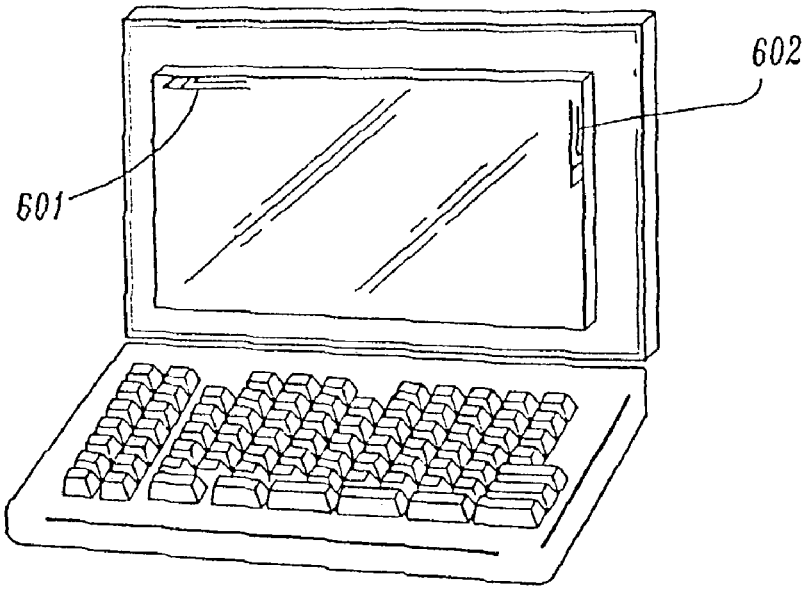

FIGS. 5 and 6 are schematic diagrams illustrating various orientations for mounting dual-band antennas on a laptop display unit according to the invention. The mounting of dual-band antennas (501, 502, 601, and 602) is similar to that as discussed above with reference to FIGS. 3 and 4. The dual-band antennas (501, 502, 601, 602) are referred to herein as "inverted-F dual-band antennas", the structure of which will be described in further detail below. An inverted-F dual band antenna (501, 502, 601, 602) may be used as shown in FIGS. 5 and 6, for applications where space is limited. An inverted-F antenna is about half the length of a slot antenna. At the lower frequency band, the inverted-F antenna has wide standing wave ratio (SWR) bandwidth, but the gain value is usually lower than that of the slot antenna. As described in further detail below, for both a slot and an inverted-F dual-band antenna according to the invention, impedance matching is achieved by moving the feed line in a certain direction to either increase or decrease the impedance at the lower band.

It is to be understood that the antennas shown in FIGS. 3, 4, 5 and 6 may be implemented together. For example, a parallel inverted-F dual band antenna and a perpendicular slot dual band antenna may be mounted on the same device.

Figure 7:
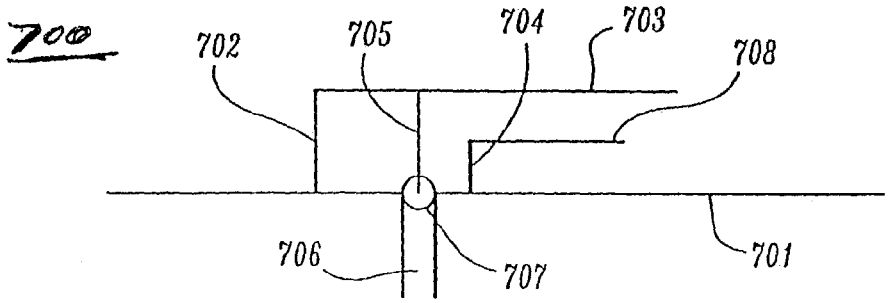
FIG. 7 illustrates an inverted-F dual-band antenna according to an embodiment of the present invention.

FIG. 7 illustrates a general architecture of an "inverted-F dual-band antenna" according to an embodiment of the present invention. The exemplary inverted-F dual-band antenna (700) of FIG. 7 comprises a first radiating element (or inverted-F antenna element) comprising components (702) and (703), and a second radiating element (or inverted-L antenna element) comprising components (704) and (708). The first and second radiating elements are connected to a ground element (701). The ground element (701) is provided by, e.g., a laptop display frame, a metal support structure or RF shielding foil on the back of the display. An antenna feed is preferably implemented using a coaxial transmission line (706), wherein an inner conductor (705) of the coaxial transmission line (706) is connected to the first radiating element as shown, and an outer conductor (707) (or outer metal shield) of the coaxial cable (706) is connected to the ground plate (701). It is to be appreciated that the dual-band antenna (700), including components (702-704) and (708), may be formed of a single thin wire or stamped from a metal sheet. The dual-band antenna (700) (and other dual-band antenna structures described herein) can be readily implemented on a printed circuit board (PCB).

Figure 8:
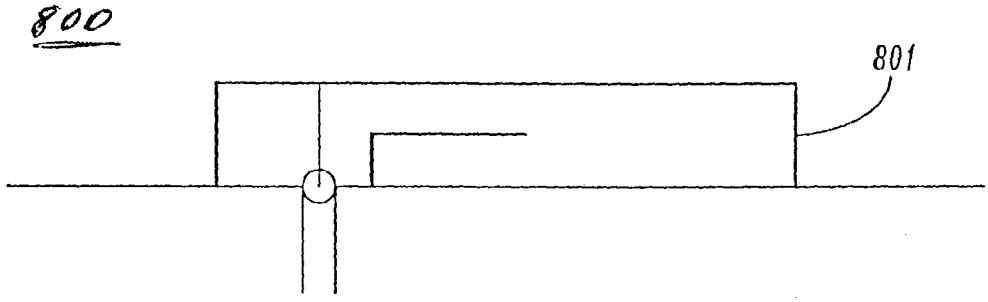
FIG. 8 illustrates a slot dual-band antenna according to an embodiment of the present invention.

FIG. 8 illustrates a general architecture of a "slot dual-band antenna" according to an embodiment of the present invention. The exemplary slot dual-band antenna (800) shown in FIG. 8 is similar in structure as the antenna (700) shown in FIG. 7, but the first radiating element further includes component (801) closing an outside loop. Thus, the dual-band antenna (800) comprises a first radiating element (outer element) comprising a slot antenna element and a second radiating element (inner element) comprising an inverted-L antenna element.

Figure 9:
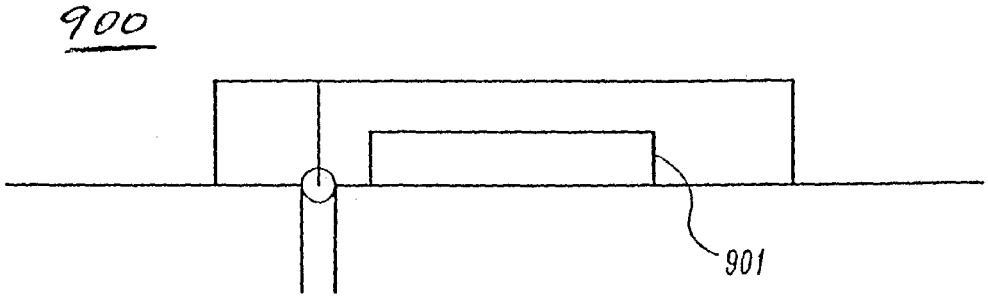
FIG. 9 illustrates a slot-slot dual-band antenna according to an embodiment of the present invention.

FIG. 9 illustrates a general architecture of a "slot-slot dual-band antenna" according to an embodiment of the present invention. The exemplary slot-slot dual-band antenna (900) shown in FIG. 9 is similar in structure as the antenna (800) shown in FIG. 8, but the second radiating element further includes component (901) closing an inside loop. Thus, the dual-band antenna (900) comprises a first radiating element (outer element) comprising a slot antenna element and a second radiating element (inner element) comprising a slot antenna element.

Figure 22:
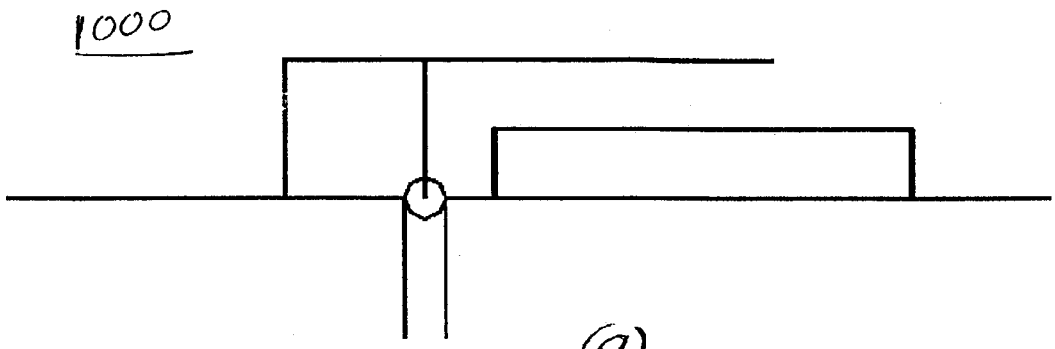
FIG. 22(*a*) illustrates a dual-band antenna according to another embodiment of the invention.
Figure 22:
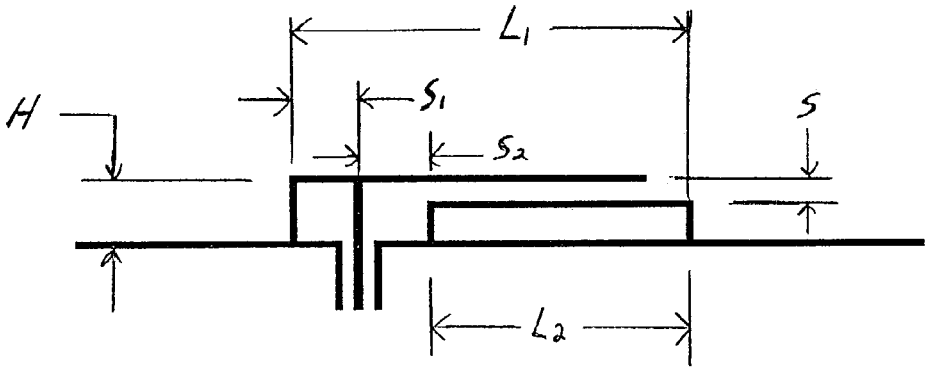
Figure 22:
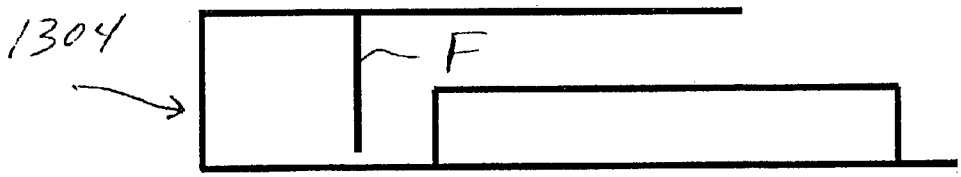

FIG. 22(*a*) illustrates a general architecture of an inverted-F dual band antenna according to another embodiment of the present invention. The dual-band antenna (1000) of FIG. 22(*a*) is similar in structure to the inverted-F dual band antenna (700) of FIG. 7, except that the second radiating element (inner antenna element) comprises a slot antenna element (as opposed to an inverted-L antenna element).

Figure 10:
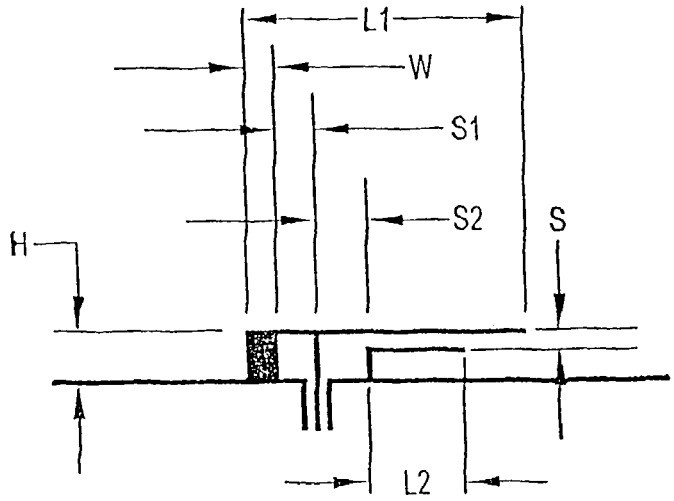
FIGS. 10(*a*) and 10(*b*) are exemplary diagrams illustrating dimensional parameters of an inverted-F dual-band antenna according to an embodiment of the present invention, which are used for determining operating characteristics of the dual-band antenna.

Referring now to FIGS. 10(*a*) and 10(*b*), operation principles of an "inverted-F dual-band antenna" according to an embodiment of the invention (such as shown in FIG. 7) will be discussed. In the embodiment of FIG. 10(*a*), for the lower frequency band of the antenna, the resonant frequency of the first radiating element (the outer inverted-F element) is determined primarily by the total length H+L1 of the first radiating element, which total length is about one quarter wavelength long at the center of the lower frequency band. Increasing the length of L1 will reduce the resonate frequency in the lower band. The impedance of the antenna can be changed by moving the feed point. More specifically, increasing S1 (moving the feed line to the right) will increase the input impedance of the antenna at the low band. Making W narrower will achieve the same effect. Further, decreasing S1 (moving the feed line to the left) will decrease the input impedance of the antenna at the low band.

Figure 10B:
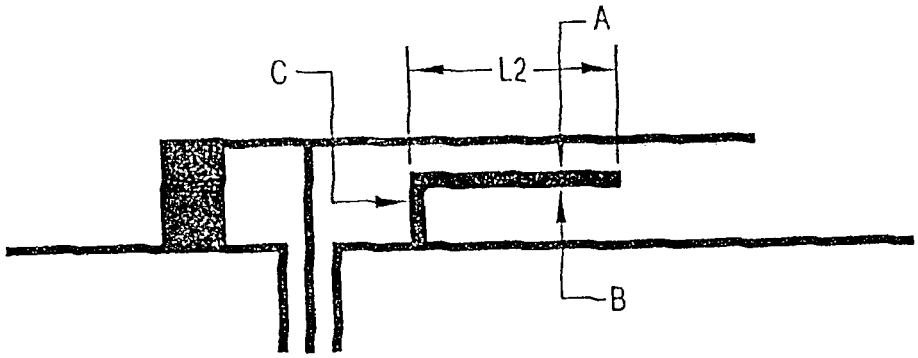

For the high frequency band of the antenna, the resonant frequency of the second radiating element (the inner inverted-L element) is determined primarily by the total length L2+(H−S), which total length is about one-quarter wavelength long at the center of the high band. The antenna impedance in the high band is primarily determined by the coupling distances S and S2. More specifically, referring to FIG. 10*b*, generally speaking, the impedance for the high band can be changed according to the following relationships: moving edge A up (closer to the first radiating element) will increase the impedance; moving edge B down (closer to ground) will decrease the impedance; and moving edge C to the left (towards the feed) will increase the impedance. Furthermore, the bandwidth of the antenna in both the lower and high bands can be increased by increasing the width of the line strips of the antenna elements. Further, the bandwidth of the lower band can be widened by increasing H.

Figure 11:
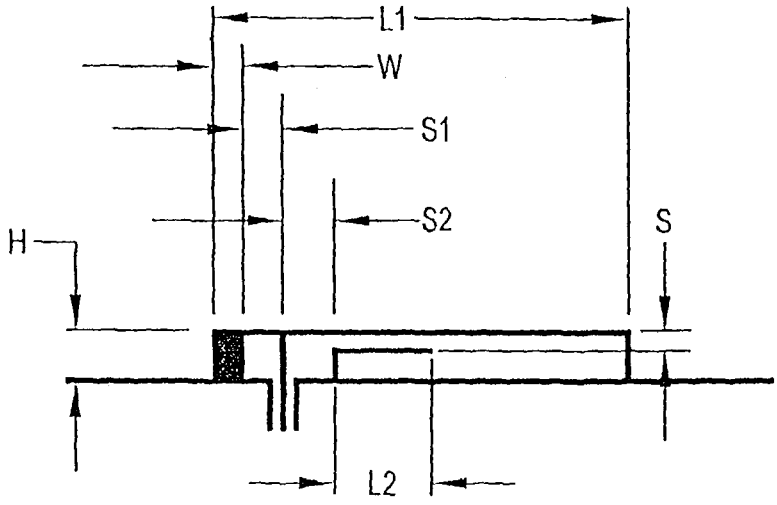
FIG. 11 is an exemplary diagram illustrating dimensional parameters of a slot dual-band antenna according to an embodiment of the present invention, which are used for determining operating characteristics of the dual-band antenna.

Referring now to FIG. 11, operation principles of a "slot dual-band antenna" according to an embodiment of the invention (such as shown in FIG. 8) will be discussed. In the embodiment of FIG. 11, for the lower frequency band of the antenna, the resonant frequency of the first radiating element (the outer slot antenna element) is determined primarily by the total length 2H+L1 of the first radiating element, which total length is about one-half wavelength long at the center of the lower frequency band. For the higher frequency band of the antenna, the resonant frequency of the second radiating element (the inner inverted-L antenna element) is determined primarily by the total length L2+(H−S), which total length is about one-quarter wavelength long at the center of the high band.

Figure 12:
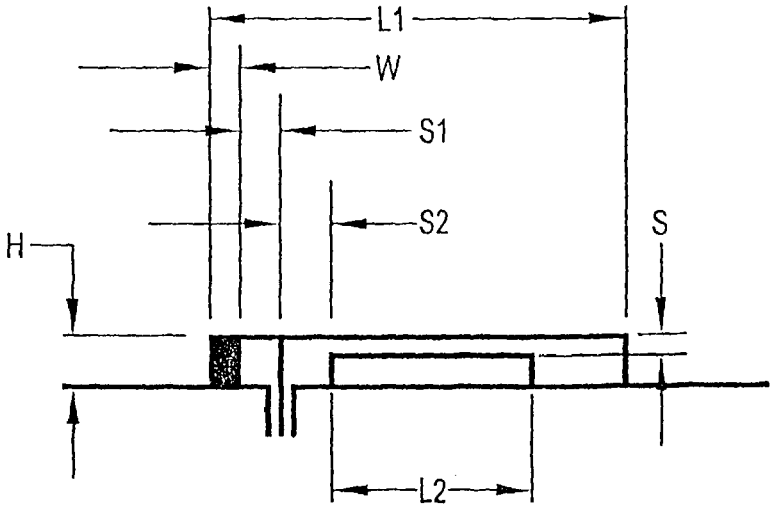
FIG. 12 is an exemplary diagram illustrating dimensional parameters of a slot-slot dual-band antenna according to an embodiment of the present invention, which are used for determining operating characteristics of the dual-band antenna.

Referring to FIG. 12, operation principles of a "slot-slot dual-band antenna" according to an embodiment of the invention (such as shown in FIG. 9) will be discussed. In the embodiment of FIG. 12, for the lower frequency band of the antenna, the resonant frequency of the first radiating element (the outer slot antenna element) is determined primarily by the total length 2H+L1 of the first radiating element, which total length is about one-half wavelength long at the center of the lower frequency band. For the higher frequency band of the antenna, the resonant frequency of the second radiating element (the inner slot antenna element) is determined primarily by the total length L2+2(H−S) of the second radiating element, which total length is about one-half wavelength long at the center of the high band.

Referring to FIG. 22(*b*), operation principles of an inverted-F dual band antenna (such as shown in FIG. 22(*a*)) according to another embodiment of the invention will be discussed. In the embodiment of FIG. 22(*b*), for the lower frequency band of the antenna, the resonant frequency of the first radiating element (the outer inverted-F antenna element) is determined primarily by the total length H+L1 of the first radiating element, which total length is about one-quater wavelength long at the center of the lower frequency band. For the higher frequency band of the antenna, the resonant frequency of the second radiating element (the inner slot antenna element) is determined primarily by the total length L2+2(H−S) of the second radiating element, which total length is about one-half wavelength long at the center of the high band.

It is to be understood that the antenna impedance and resonate frequencies of the antenna elements for the antenna structures described above in FIGS. 11, 12 and 22(*b*) are tuned/determined in essentially the same way as described above with respect to FIGS. 10(*a*) and 10(*b*). For example, for a dual-band antenna according to the present invention, the input impedance match is effected by factors including, inter alia, the coupling distances S and S2, as well as the height H of the first radiating element. Further, the band of the antenna can affect the relationships, for example, the relationships observed for a 2.4 GHz band antenna may not be the same as the relationships observed for a 5 GHz band antenna. Therefore, determining the input impedance match for a dual-band antenna according to the present invention can be done according to experimentation. The experimentation and relationships for different antennas can be readily determined by one of ordinary skill in the art based on the teachings herein.

Figure 13:
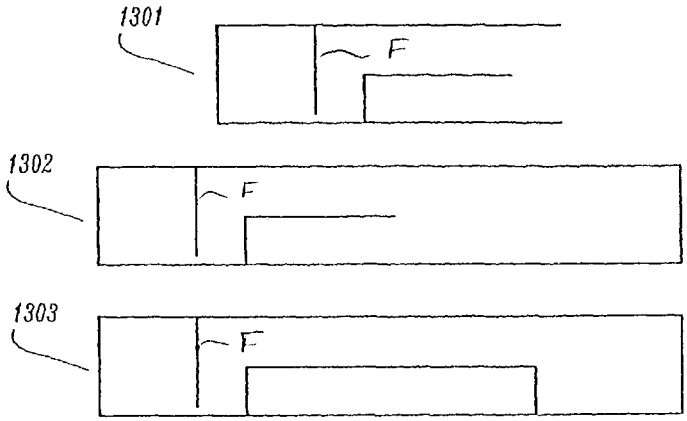
FIG. 13 illustrates various dual-band antenna architectures according to embodiments of the invention, which may be implemented by stamping a metal sheet or patterning a PCB (printed circuit board).

FIG. 13 are schematic diagrams illustrating dual-band antennas according embodiments of the invention, wherein the antenna components are fabricated by either stamping a metal sheet (e.g., RF foil) or patterning a PCB. More specifically, FIG. 3 schematically illustrates an inverted-F dual-band antenna (1301), a slot dual-band antenna (1302), and a slot-slot dual-band antenna (1303). Further, FIG. 22(*c*) is a schematic diagram illustrating an inverted-F dual-band antenna (1304) (based on the architecture shown in FIGS. 22(*b,c*)) that can be fabricated by stamping a metal sheet or patterning a PCB. In each of the dual-band antenna embodiments shown in FIGS. 13 and 22(*c*), a feed element ("F") is formed, which is connected to the first (outer) radiating element. The feed element F provides means for connecting a signal feed to the antenna (e.g., connecting an inner conductor of a coaxial cable to F).

Figure 14:
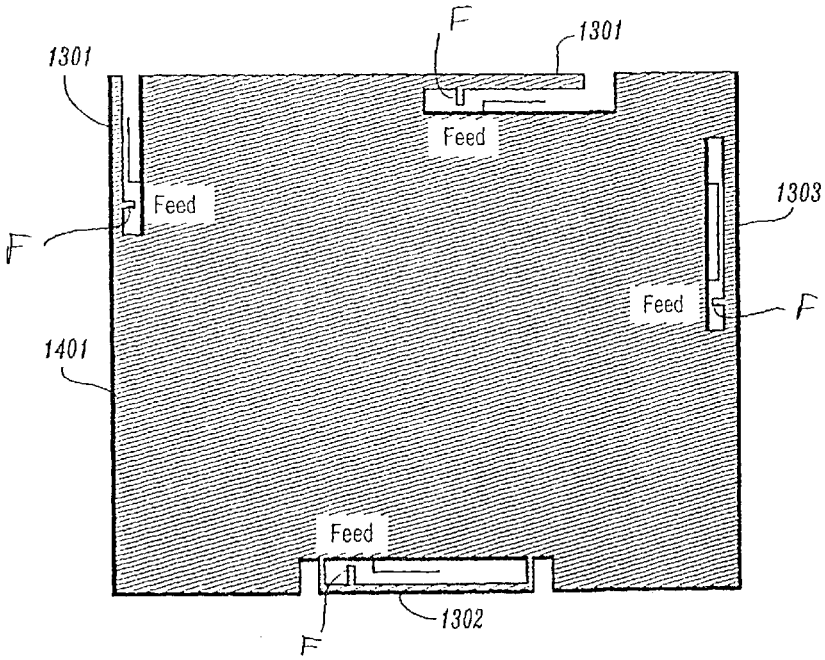
FIG. 14 illustrates various dual-band antenna architectures according to embodiments of the invention that are constructed using RF foil of a display unit.

By way of example, FIG. 14 is illustrates embodiments of the antennas (1301, 1302, and 1303) of FIG. 13 which are built on an RF shielding foil (1401) on the back of a display. The feed portion F of the antennas can be connected to the inner conductor of a coaxial cable and the outer conductor (ground/shield) of the coaxial cable is connected to the RF foil opposite to the feed portion F. To ensure that antennas built from the RF shielding foil have desirable efficiency, the RF shielding foil preferably comprises a conductor material such as aluminum, copper, brass or gold, or other materials that provide good conductivity. It is to be understood that although not specifically shown in FIG. 14, the dual-band antenna (1304) depicted in FIG. 22(*c*) can be formed on RF foil using the same patterns illustrated in FIG. 14 for the various antenna elements.

In another embodiment, for laptops with displays having metallic covers, the first and second radiating elements of a dual-band antenna can be formed as part of the metallic cover using patterns similar to those depicted in FIG. 14 for the various antenna elements.

Figure 15:
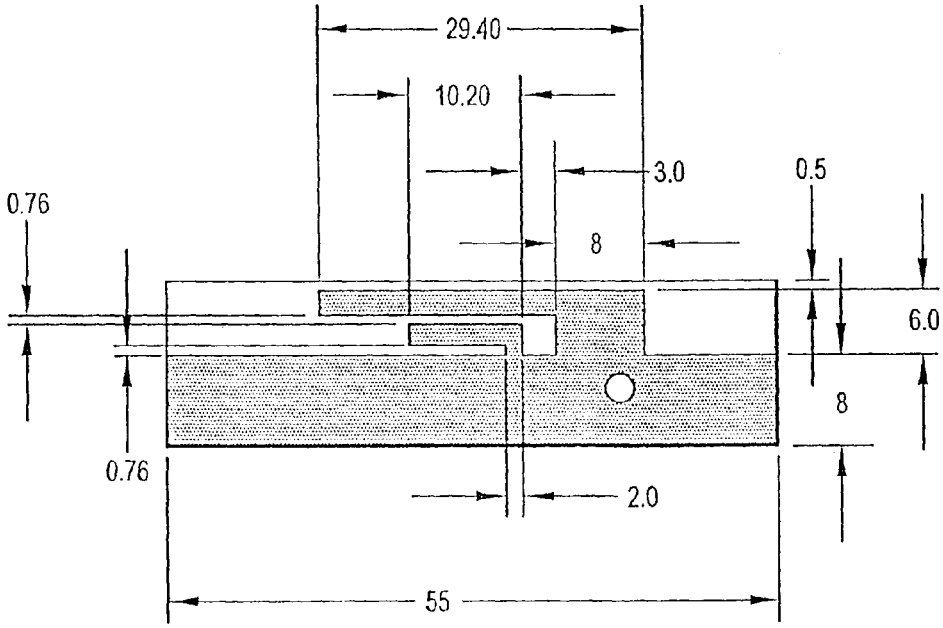
FIG. 15 illustrates a dual-band antenna according to an embodiment of the invention, which is constructed by patterning a PCB.
Figure 15:
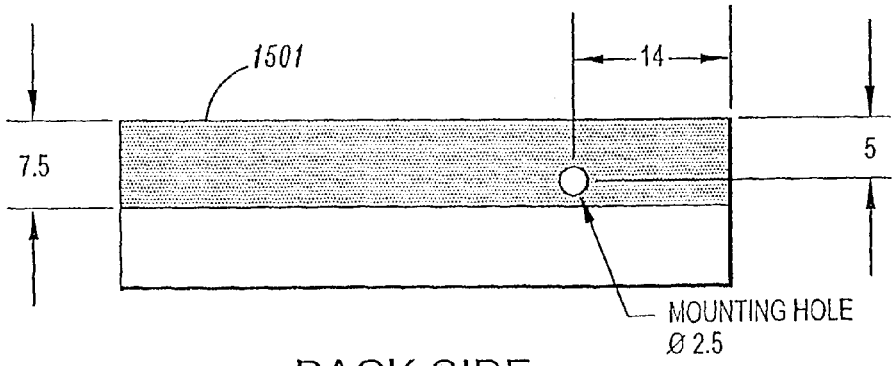

Furthermore, as noted above, the antenna elements of a dual-band antenna according to the invention may comprise metallic strips that are formed on a substrate (e.g. copper strips formed on a PCB). FIG. 15 is a diagram illustrating dimensions of an exemplary dual-band antenna according to an embodiment of the invention, which is fabricated on a PCB. In particular, FIG. 15 illustrates an inverted-F dual-band antenna that is fabricated on a 0.01" thick GETEK PCB, which has a 3.98 dielectric constant and a 0.014 loss tangent measured from 0.3 GHz to 6 GHz. In the embodiment of FIG. 15, a double-sided PCB is shown, wherein the antenna elements are formed on one (front) side of the PCB and a ground strip (1501) is formed on the backside of the PCB. The measurements shown in FIG. 15 are in mm. It is to be understood that the dimensions shown in FIG. 15 are just one exemplary embodiment of a dual-band antenna according to the invention and that the antenna dimensions are application dependent. The mounting hole is used to mount (via a screw) the PCB antenna to the display frame of a laptop display unit (e.g., IBM ThinkPad display unit with an ABS cover). It is to be understood that a single-sided PCB can also be used. Removing the strip (1501) on the backside of the PCB does not affect the antenna performance. The strip can be made of any conductive material, for example, copper.

Figure 16:
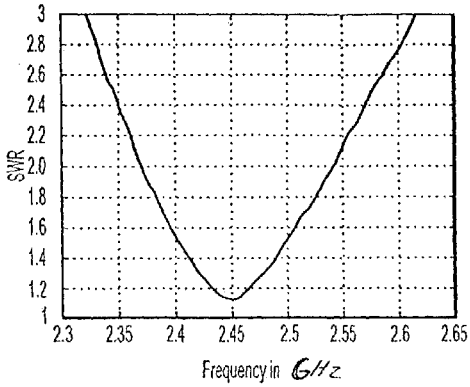
FIG. 16 illustrates the measured SWR (standing wave ratio) of the dual-band antenna of FIG. 15 (as mounted in a laptop display) as a function of frequency in a 2.4 GHz frequency band.
Figure 17:
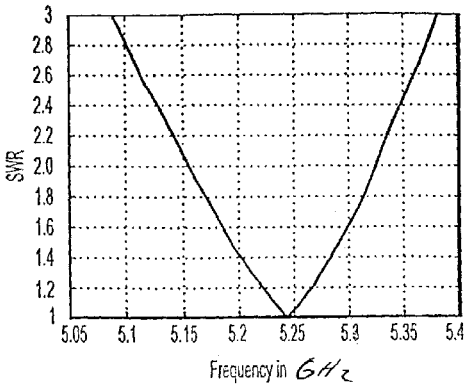
FIG. 17 illustrates the measured SWR (standing wave ratio) of the dual-band antenna of FIG. 15 (as mounted in a laptop display) as a function of frequency in a 5 GHz frequency band.

SWR (standing wave ratio) and radiation measurements were performed for a dual-band antenna having the structure and dimensions shown in FIG. 15 as mounted inside an IBM ThinkPad laptop. The results of such measurements are shown in FIGS. 16-19. In particular, FIGS. 16 and 17 illustrate the measured SWR of the dual-band antenna in the 2.4 GHz and 5 GHz bands, respectively. In the exemplary embodiment, the antenna was designed to operate in the 2.4 GHz ISM band (low band) and the lower portion of the 5 GHz U-NII band (high band). As shown in FIG. 16, for the low band with a center frequency of about 2.45 GHz, the antenna provides sufficient SWR bandwidth (2:1) in the entire band from 2.4 GHz to 2.5 GHz. Further, as shown in FIG. 17, for the high band with a center frequency of about 5.25 GHz, the antenna provides sufficient SWR bandwidth (2:1) for most of the band from 5.15 GHz to 5.35 GHz, although the band can be completely covered with optimization.

Table 1 below shows the measured dual-band antenna gain values at different frequencies.

TABLE 1

| | | | | | | |
|---|---|---|---|---|---|---|
| 2.4 GHz | Freq. (GHz) | 2.35 | 2.4 | 2.45 | 2.5 | 2.55 |
| | Ave/Peak Gains (dBi) | −1.8/1.8 | −0.9/1.7 | −0.5/2.3 | −0.6/2.4 | −1.4/2.0 |
| 5 GHz | Freq. (GHz) | −5.05 | 5.15 | 5.25 | 5.35 | 5.45 |
| | Ave/Peak Gains (dBi) | −0.7/3.2 | −0.7/2.9 | −1.0/3.3 | −1.7/3.3 | −2.9/1.9 |

Figure 18:
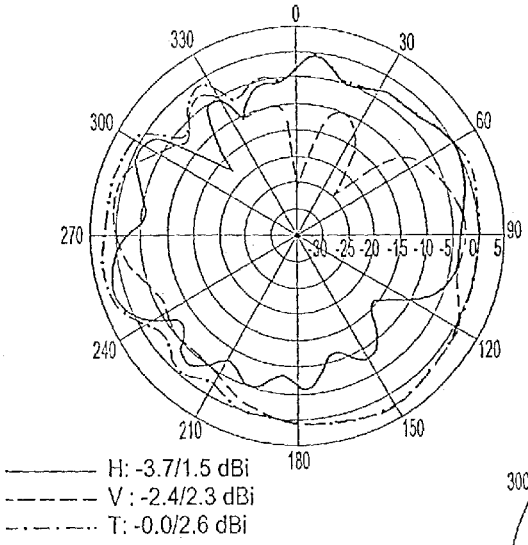
FIG. 18 is a graphical diagram illustrating measured radiation patterns of the dual-band antenna of FIG. 15 (as mounted in a laptop display) at 2.45 GHz.
Figure 19:
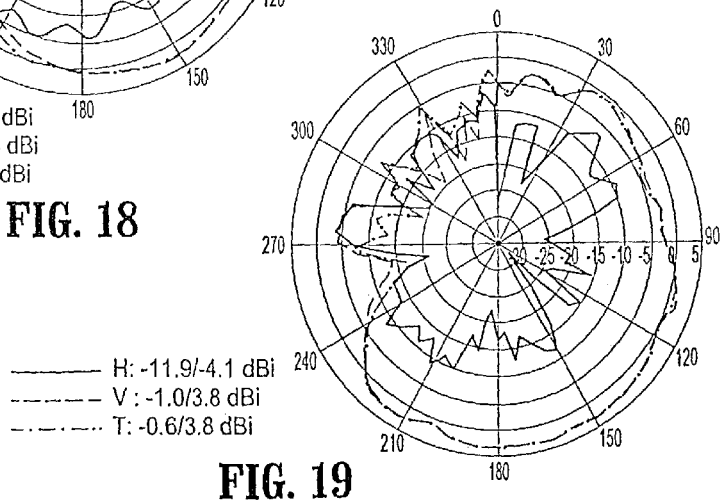
FIG. 19 is a graphical diagram illustrating measured radiation patterns of the dual-band antenna of FIG. 15 (as mounted in a laptop display) at 5.25 GHz.
Figure 20:
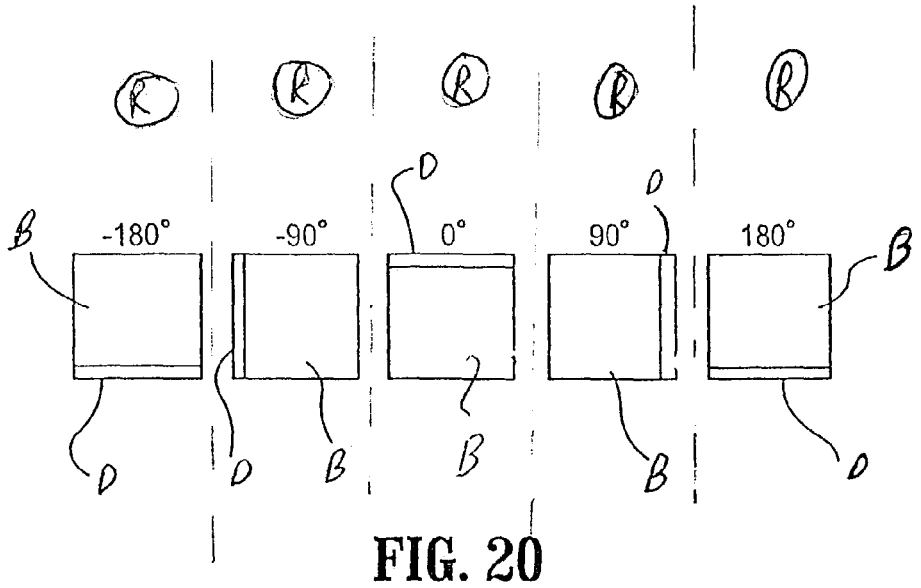
FIG. 20 are top perspective views of various orientations of the laptop (base and display) during the radiation measurements of FIGS. 18 and 19.

FIGS. 18 and 19 show the horizontal plane radiation patterns at 2.45 GHz and 5.25 GHz, respectively, for various orientations of the laptop as shown in FIG. 20. The antenna at 2.45 GHz has both vertical and horizontal polarization, but it has a substantially vertical polarization at 5.25 GHz. The effect of the laptop display on the radiation patterns is obvious. The solid lines denote the horizontal polarization, the dashed lines denote the vertical polarization, and the dash-dot lines denote the total radiation pattern. In the legends of FIGS. 18 and 19, H, V, and T denote the horizontal, vertical and total electrical fields, respectively, and the number before the slash (/) is the average gain value while the number after the slash (/) is the peak gain values on the horizontal plane.

FIG. 20 shows the laptop orientation (top view) corresponding to the radiation measurements shown in FIGS. 18 and 19. In particular, FIG. 20 illustrates a top view of the laptop orientation during each radiation measurement when the laptop was open and the angle between the display (D) and the base (B) was about 90 degrees. The receiver (R) was positioned as shown at a certain distance from the laptop as the laptop was rotated 360 degrees, with the dual-band antenna transmitting a signal at each of the frequencies in FIGS. 18 and 19.

Figure 21:
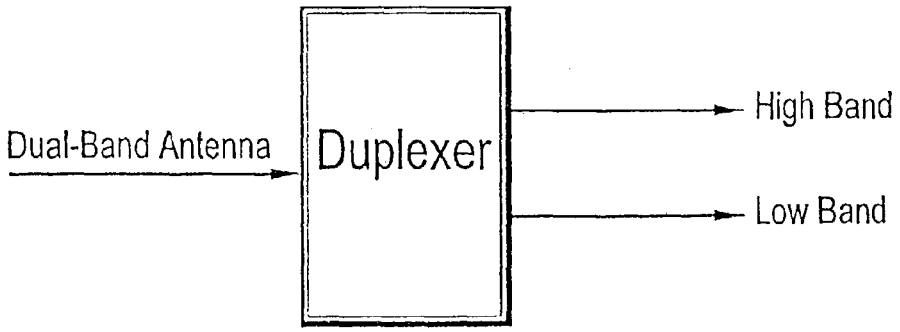
FIG. 21 illustrates a duplexer according to an embodiment of the present invention.

Referring to FIG. 21, using a dual-band antenna and a duplexer, for example, implemented on a printed circuit board, two communications systems can work simultaneously. For laptop applications, the low band for Bluetooth (IEEE 802.11b) at the 2.4 GHz ISM band and the high band for IEEE 802.11a at U-NII band. Other combinations would be obvious to one skilled in the art in light of the present invention.

Although illustrative embodiments have been described herein with reference to the accompanying drawings, it is to be understood that the present invention is not limited to those precise embodiments, and that various other changes and modifications may be affected therein by one skilled in the art without departing from the scope of the invention.

What is claimed is:

1. A dual-band antenna for a portable device, comprising:

a first planar element having a resonant frequency in a first frequency band; and a second planar element having a resonant frequency in a second frequency band, and a planar antenna ground element;

wherein the first planar element is connected to a signal feed, wherein the first and second planar elements are connected to the planar antenna ground element, wherein the first and second planar elements are arranged coplanar to the planar antenna ground element and wherein the dual-band antenna is integrated within a portable device.

2. The antenna of claim 1, wherein the first planar element comprises an inverted-F antenna element and the second planar element comprises an inverted-L antenna element.

3. The antenna of claim 1, wherein the first planar element comprises an inverted-F antenna element and the second planar element comprises a slot antenna element.

4. The antenna of claim 1, wherein the first planar element comprises a slot antenna element and the second planar element comprises a slot antenna element.

5. The antenna of claim 1, wherein the first planar element comprises a slot antenna element and the second planar element comprises an inverted-L antenna element.

6. An antenna, comprising:

a planar ground element;

a first planar radiating element having a first resonant frequency in a first standard designated frequency band; and a second planar radiating element having a second resonant frequency in a second standard designated frequency band, which is different from the first standard designated frequency band, wherein the first and second planar radiating elements are connected to the planar ground element, and wherein the first and second planar radiating elements are arranged coplanar to the planar ground element.

7. The antenna of claim 6, wherein the first planar radiating element comprises an inverted-F antenna element and the second planar radiating element comprises an inverted-L antenna element.

8. The antenna of claim 6, wherein the first planar radiating element comprises an inverted-F antenna element and the second planar radiating element comprises a slot antenna element.

9. The antenna of claim 6, wherein the first planar radiating element comprises a slot antenna element and the second planar radiating element comprises a slot antenna element.

10. The antenna of claim 6, wherein the first planar radiating element comprises a slot antenna element and the second planar radiating element comprises an inverted-L antenna element.

11. The antenna of claim 6, further comprising a planar substrate, wherein the first and second planar radiating elements and planar ground element comprise metal patterns formed on a surface of the planar substrate.

12. The antenna of claim 6, wherein only one of the first and second planar radiating elements is connected to an antenna feed line such that one of the first and second planar radiating element is capacitively fed.

13. A wireless communications device, comprising:

an integrated wireless communications system; and an integrated antenna coupled to the integrated wireless communications system, wherein the integrated antenna comprises:

a planar ground element;

a first planar radiating element having a first resonant frequency in a first standard designated frequency band; and a second planar radiating element having a second resonant frequency in a second standard designated frequency band, which is different from the first standard designated frequency band, wherein the first and second planar radiating elements are connected to the planar ground element, and wherein the first and second planar radiating elements are arranged coplanar to the planar ground element.

14. The wireless communications device of claim 13, wherein the first planar radiating element comprises an inverted-F antenna element and the second planar radiating element comprises an inverted-L antenna element.

15. The wireless communications device of claim 13, wherein the first planar radiating element comprises an inverted-F antenna element and the second planar radiating element comprises a slot antenna element.

16. The wireless communications device of claim 13, wherein the first planar radiating element comprises a slot antenna element and the second planar radiating element comprises a slot antenna element.

17. The wireless communications device of claim 13, wherein the first planar radiating element comprises a slot antenna element and the second planar radiating element comprises an inverted-L antenna element.

18. The wireless communications device of claim 13, wherein the integrated antenna further comprises a planar substrate, wherein the first and second planar radiating elements and planar ground element comprise metal patterns formed on a surface of the planar substrate.

19. The wireless communications device of claim 13, wherein the wireless communications device is a laptop computer comprising a display unit, wherein the integrated antenna is disposed in the display unit.

20. The wireless communications device of claim 19, wherein the display unit comprises an display screen and support frame to support the display screen within the display unit, wherein the integrated antenna is mounted to the support frame.

* * * * *